US012736289B2

(12) United States Patent
Wang et al.

(10) Patent No.: US 12,736,289 B2
(45) Date of Patent: Sep. 15, 2026

(54) HEAT EXCHANGER, AND METHOD FOR PROCESSING HEAT EXCHANGER

(71) Applicant: SANHUA (HANGZHOU) MICRO CHANNEL HEAT EXCHANGER CO., LTD., Hangzhou (CN)

(72) Inventors: Dong Wang, Hangzhou (CN); Zhongyao Tong, Hangzhou (CN); Xiaoming Zhong, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 109 days.

(21) Appl. No.: 18/693,439

(22) PCT Filed: Sep. 30, 2022

(86) PCT No.: PCT/CN2022/123596

§ 371 (c)(1),
(2) Date: Mar. 19, 2024

(87) PCT Pub. No.: WO2023/051829

PCT Pub. Date: Apr. 6, 2023

(65) Prior Publication Data

US 2025/0129991 A1 Apr. 24, 2025

(30) Foreign Application Priority Data

Sep. 30, 2021 (CN) ..... 202111165535.0
Sep. 30, 2021 (CN) ..... 202122411190.4

(51) Int. Cl.
*F28D 7/16* (2006.01)
*F28F 9/02* (2006.01)

(52) U.S. Cl.
CPC . *F28D 7/16* (2013.01); *F28F 9/02* (2013.01)

(58) Field of Classification Search
CPC . F28D 7/16; F28D 7/00; F28D 1/0391; F28D 1/03; F28D 1/02; F28D 1/00; F28F 9/02; F28F 2275/06; F28F 2275/00
(Continued)

(56) References Cited

U.S. PATENT DOCUMENTS 8,919,147 B2 * 12/2014 Wolk ..... F25B 39/04 62/509
9,891,007 B2 * 2/2018 He ..... B21D 53/06
(Continued)

FOREIGN PATENT DOCUMENTS

CN 104061719 A 9/2014
CN 104344745 A 2/2015
(Continued)

*Primary Examiner* — Lawrence Averick
(74) *Attorney, Agent, or Firm* — Bridgeway IP Law Group, PLLC; Jihun Kim

(57) ABSTRACT

A method for processing a heat exchanger includes: preparing a plurality of heat exchange tube semi-finished products, each heat exchange tube semi-finished product including a first wall and a second wall arranged in a thickness direction of the heat exchange tube semi-finished product, and the second wall having a first gap penetrating the second wall in the thickness direction; arranging N heat exchange tube semi-finished products spaced apart by a predetermined distance in a first direction, N>4, the thickness direction of the heat exchange tube semi-finished product being parallel or angled to the first direction, and in the first direction, the arranged heat exchange tube semi-finished products being sequentially defined as a first tube, a second tube, . . . , a N−1th tube, and a Nth tube; placing the second wall of the first tube towards the second tube; and placing the second wall of the Nth tube towards the N−1th tube.

8 Claims, 15 Drawing Sheets

(58) Field of Classification Search
USPC ..... 29/890.03, 592
See application file for complete search history.

(56) References Cited

U.S. PATENT DOCUMENTS

| | | | | |
|---|---|---|---|---|
| 2008/0314075 | A1* | 12/2008 | Wolk | F25B 39/04 165/41 |
| 2012/0227939 | A1* | 9/2012 | Aplienz | F28F 13/12 29/890.053 |
| 2016/0290736 | A1* | 10/2016 | He | F28F 1/025 |
| 2020/0200489 | A1* | 6/2020 | McDermott | B21C 37/151 |
| 2024/0035754 | A1* | 2/2024 | Tong | F28F 1/40 |

FOREIGN PATENT DOCUMENTS

| | | | |
|---|---|---|---|
| CN | 110530177 | A | 12/2019 |
| CN | 214582724 | U | 11/2021 |
| CN | 217210509 | U | 8/2022 |
| JP | 2000168343 | A | 6/2000 |
| JP | 2014181868 | A | 9/2014 |

* cited by examiner

HEAT EXCHANGER, AND METHOD FOR PROCESSING HEAT EXCHANGER

CROSS-REFERENCE TO RELATED APPLICATIONS

The present application is a national phase entry under 35 USC § 371 of International Application No. PCT/CN2022/123596, filed on Sep. 30, 2022, which claims priority to and benefits of Chinese Patent Application No. 202111165535.0, filed on Sep. 30, 2021, and Chinese Patent Application No. 202122411190.4, filed on Sep. 30, 2021, the entire content of which is incorporated herein by reference.

FIELD

The present disclosure relates to a field of heat exchange technologies, and more particularly to a heat exchanger and a method for processing the same.

BACKGROUND

In the related art, a heat exchanger includes a collecting tube and a heat exchange tube, the heat exchange tube is a folded flat tube, the folded flat tube is formed by folding plates, and two ends of the folded flat tube are connected with the collecting tubes, respectively. In a process of manufacturing the heat exchanger, the collecting tube and a plurality of heat exchanger tubes are fixed by welding. Due to the processing temperature change and distribution difference in the welding process of the heat exchanger, the local stress concentration of the heat exchanger tends to occur, resulting in the deformation and even leakage of the heat exchange tube, and affecting the reliability of the heat exchanger.

SUMMARY

A first aspect of the present disclosure provides a heat exchanger, including a first header, a second header, and a heat exchange tube communicated with the first header and the second header. The heat exchange tube includes a folded tube section formed by welding an alloy plate after being folded, and the folded tube section includes one or more channels extending along a length direction of the folded tube section; a plurality of folded tube sections are arranged at intervals along a length direction of the first header; the folded tube section includes a tube wall including a first seam, and the first seam extends along the length direction of the folded tube section; the tube wall includes a first wall and a second wall arranged along a thickness direction of the folded tube section, and the second wall includes the first seam; one end of the first header in its length direction includes a first end face, and the other end of the first header in its length direction includes a second end face; the heat exchanger includes X folded tube sections, and for any one of the X folded tube sections, a minimum distance between the first wall of the folded tube section and the first end face is less than a minimum distance between the second wall of the folded tube section and the first end face, the minimum distance between the first wall of the folded tube section and the first end face is less than a distance between the first wall of the folded tube section and the second end face, and $X \geq 1$; and the heat exchanger further includes Y folded tube sections, and for any one of the Y folded tube sections, a minimum distance between the first wall of the folded tube section and the second end face is less than a minimum distance between the second wall of the folded tube section and the first end face, the minimum distance between the first wall of the folded tube section and the second end face is less than a distance between the first wall of the folded tube section and the first end face, and $Y \geq 1$.

A second aspect of the present disclosure provides a method for processing a heat exchanger, including: preparing a plurality of heat exchange tube semi-finished products, the heat exchange tube semi-finished product including a first wall and a second wall arranged in a thickness direction of the heat exchange tube semi-finished product, the heat exchange tube semi-finished product having a first gap penetrating the second wall in the thickness direction, or the first gap being formed between an end portion of the first wall and an end portion of the second wall; arranging N heat exchange tube semi-finished products spaced apart by a predetermined distance in a first direction, $N>4$, the thickness direction of the heat exchange tube semi-finished product being parallel or angled to the first direction, and in the first direction, the arranged heat exchange tube semi-finished products being sequentially defined as a first tube, a second tube, . . . , an N−1th tube, and an Nth tube; placing the second wall of the first tube towards the second tube, and the second wall of the first tube being closer to the second tube in the first direction compared to the first wall of the first tube, so that, in the first direction, a minimum distance between the second wall of the first tube and the first wall of the second tube is L1, a minimum distance between the first wall of the first tube and the first wall of the second tube is L2, and L1 is less than L2; and placing the second wall of the Nth tube towards the N−1th tube, and the second wall of the Nth tube being closer to the N−1th tube in the first direction compared to the first wall of the Nth tube, so that a minimum distance between the second wall of the Nth tube and the first wall of the N−1th tube is less than a minimum distance between the first wall of the Nth tube and the first wall of the N−1th tube in the first direction.

DETAILED DESCRIPTION

Figure 1:
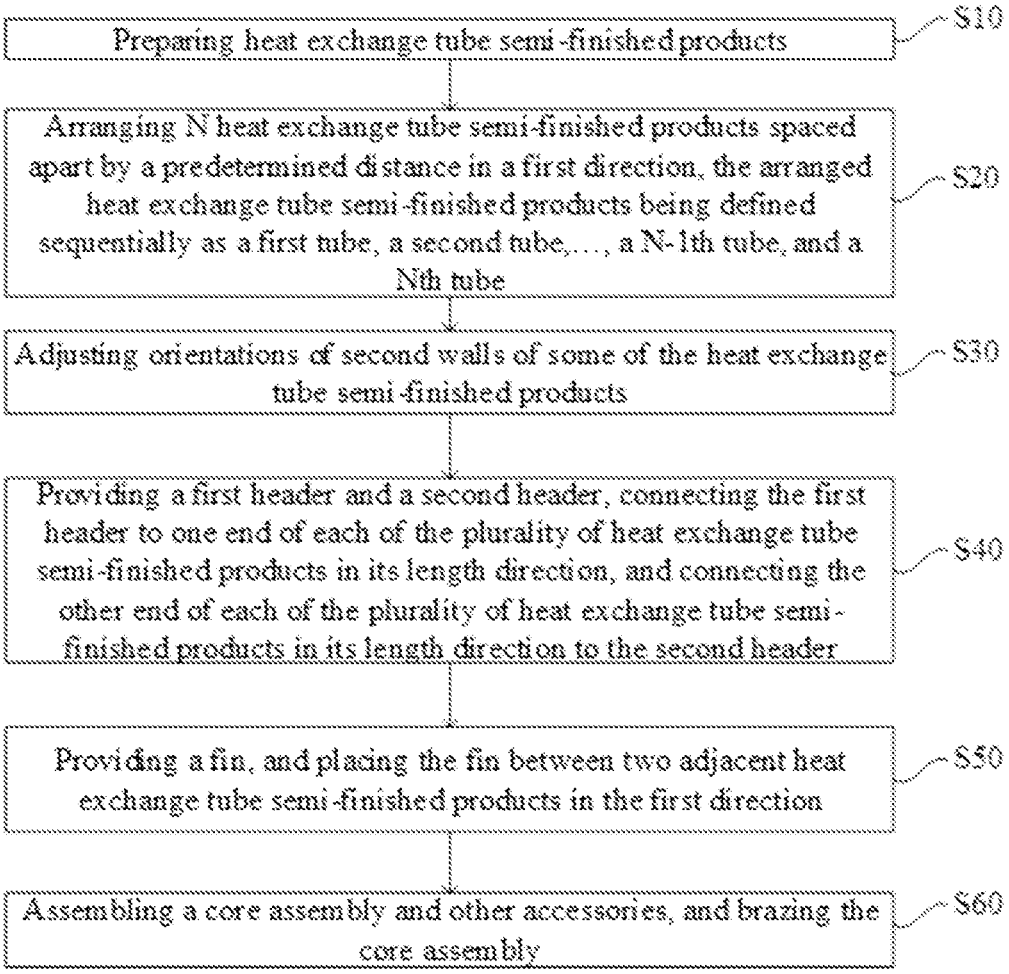
FIG. 1 is a flow chart of a method for processing a heat exchanger provided in an embodiment of the present disclosure.

Embodiments of the present disclosure are described in detail below, examples of which are shown in the accompanying drawings. The following embodiments described with reference to the accompanying drawing are illustrative. It should be understood that the embodiments described are intended to explain the present disclosure, but not to limit the present disclosure. In the description of the present disclosure, it should be understood that the orientation or position relationship indicated by the terms "center", "longitudinal", "transverse", "length", "width", "thickness", "up", "down", "front", "rear", "left", "right", "vertical", "horizontal", "top", "bottom", "inner", "outer", "clockwise", "counterclockwise", "axial", "radial" and "circumferential" and the like, is based on the orientation or position relationship shown in the accompanying drawings, which is only for the convenience of describing the present disclosure and simplifying the description, and does not indicate or imply that the referred device or element must have a specific orientation, and be constructed and operated in a specific orientation, so it cannot be understood as a limitation of the present disclosure.

A method for processing a heat exchanger according to embodiments of the present disclosure is described below with reference to the accompanying drawings.

According to the embodiments of the present disclosure, as shown in FIGS. 1 to 6, the embodiments of the present disclosure provide a method for processing the heat exchanger. The method for processing the heat exchanger includes the following steps. At step S10, a plurality of heat exchange tube semi-finished products are prepared. The heat exchange tube semi-finished product is formed by folding an alloy plate. The shape and structure of the heat exchange tube semi-finished product are roughly the same with those of a heat exchange tube obtained after processing, but various parts of the folded plate have not been fixedly connected by welding. The heat exchange tube semi-finished product includes one or more channels extending along a length direction of the heat exchange tube semi-finished product. The heat exchange tube semi-finished product includes a first wall and a second wall arranged along a thickness direction of the heat exchange tube semi-finished product. The heat exchange tube semi-finished product has a first gap penetrating the second wall in the thickness direction, or the first gap is formed between an end portion of the first wall and an end portion of the second wall. In other words, the end portion of the first wall is a first bent portion, the end portion of the second wall is a second bent portion, the first bent portion is fitted over an outer peripheral surface of the second bent portion, and the first bent portion and the second bent portion are spaced to form the first gap. At step S20, N heat exchange tube semi-finished products are arranged and spaced apart by a predetermined distance in a first direction, N is greater than 4, the thickness direction of the heat exchange tube semi-finished product is parallel or angled to the first direction, and in the first direction (the first direction is an up-down direction, i.e., the first direction may be from top to bottom, and the first direction may also be from bottom to top), the arranged heat exchange tube semi-finished products are sequentially defined as a first tube, a second tube, . . . , a N−1th tube, and a Nth tube. At step S30, the orientations of the second walls of part of the heat exchange tube semi-finished products are adjusted, so that the first gaps of all heat exchange tube semi-finished products included in the heat exchanger has two different orientations. Because of the second wall of the heat exchange tube semi-finished product having the first gap, and the processing temperature change and distribution difference in a welding process of the heat exchanger, the second wall of the heat exchange tube semi-finished product is more prone to deformation than the first wall or the first gap is poorly welded. By means of changing the orientation of the first gap, it facilitates the reduction of local stress concentration of the heat exchanger, thereby improving the reliability and service life of the heat exchanger.

When the heat exchanger is in the welding process, the first gap is filled with a melted solder, and the first gap will be welded and form a joint welding seam (i.e. a first seam 44 in the following), so that the heat exchange tube semi-finished product forms a sealed heat exchange tube section. Specifically, the solder in the first gap is heated and melted, and when the temperature is lowered, the molten solder condenses again, thus achieving the sealing of the first gap.

Specifically, when the heat exchanger is in the welding process, there is the distribution difference in the processing temperature of the heat exchanger, the thermal stresses generated by the heat exchanger in heating and cooling processes cause the heat exchange tube to deform, and the superposition of both causes the heat exchanger to be prone to the stress concentration, thus affecting the reliability and service life of the heat exchanger. Especially for the first gap on a surface of the heat exchange tube semi-finished product, in the welding process of the heat exchanger, the first gap will be welded to form the joint welding seam. However, the deformation of the heat exchange tube has an adverse effect on the welding of the first gap. The first gaps of all the heat exchange tube semi-finished products of the heat exchanger provided in the embodiments of the present disclosure have two different orientations. Because the second wall of the heat exchange tube semi-finished product has the first gap, and the heat exchanger undergoes thermal expansion and contraction in the welding process, the second wall of the heat exchange tube semi-finished product is more prone to deformation than the first wall. By means of changing the orientation of the first seam, it facilitates the reduction of the local stress concentration of the heat exchanger, thus improving the reliability and service life of the heat exchanger.

Further, the method for processing the heat exchanger provided in the embodiments of the present disclosure further includes step S40, at which, a first header and a second header are provided, and the first header and the second header extend along the first direction; one end of each of the plurality of heat exchange tube semi-finished products in its length direction is connected with the first header directly or indirectly, and the other end of each of the plurality of heat exchange tube semi-finished products in its length direction is connected with the second header directly or indirectly.

Further, the method for processing the heat exchanger provided in the embodiments of the present disclosure further includes step S50, at which, a fin is provided, and the fin is placed between two adjacent heat exchange tube semi-finished products in the first direction; alternatively, a fin is provided, and part of the fin is placed between two adjacent heat exchange tube semi-finished products in the first direction.

Further, the heat exchange tube semi-finished product, the first header, the second header, and the fin together form a core assembly, and the method for processing the heat exchanger provided in the embodiments of the present disclosure further includes step S60, at which, the core assembly and other accessories are assembled, and the core assembly is brazed, so that the heat exchange tube semi-finished product is fixedly connected with the first header and the second header, the heat exchange tube semi-finished product is fixedly connected with the fin, and the heat exchange tube semi-finished product becomes the heat exchange tube via brazing.

Figure 2:
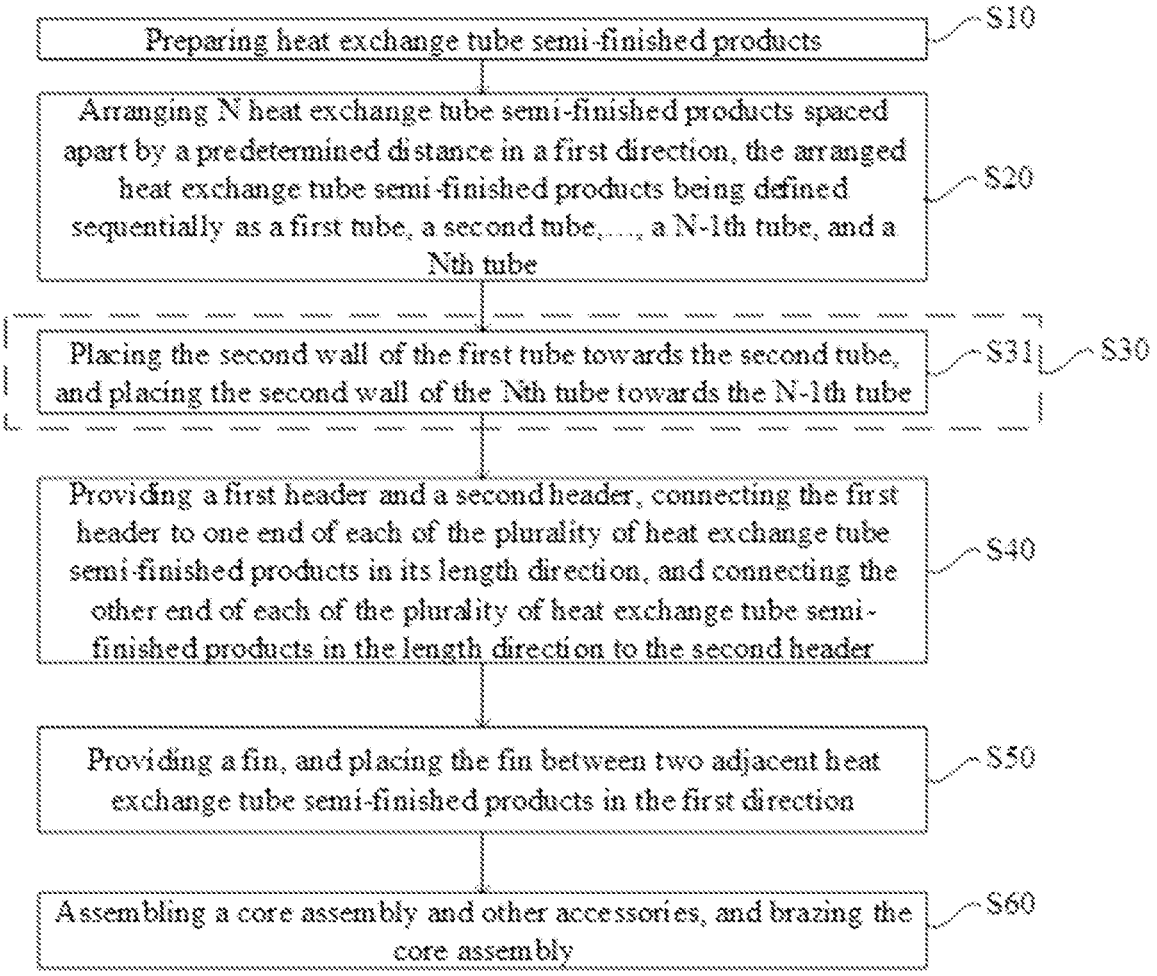
FIG. 2 is a flow chart of another method for processing a heat exchanger provided in an embodiment of the present disclosure.

As shown in FIG. 2, step S30 includes step S31. Specifically, at step S30, the second wall of the first tube is placed towards the second tube, and the second wall of the first tube is closer to the second tube in the first direction compared to the first wall of the first tube, so that a minimum distance between the second wall of the first tube and the first wall of the second tube in the first direction is less than a minimum distance between the first wall of the first tube and the first wall of the second tube in the first direction; the second wall of the Nth tube is placed towards the N−1th tube, and the second wall of the Nth tube is closer to the N−1th tube in the first direction compared to the first wall of the Nth tube, so that a minimum distance between the second wall of the Nth tube and the first wall of the N−1th tube in the first direction is less than a minimum distance between the first wall of the Nth tube and the first wall of the N−1th tube in the first direction. With this processing method, the second walls of the heat exchange tube semi-finished products at two edges of the heat exchanger are oriented towards the inside of the heat exchanger. Since the second wall of the heat exchange tube semi-finished product has the first gap, and the heat exchanger undergoes thermal expansion and contraction in the welding process, the second wall of the heat exchange tube semi-finished product is more prone to deformation than the first wall. By means of changing the orientation of the first gap, the first gap is oriented towards the inside of the heat exchanger, it facilitates the reduction of local stress concentration of the heat exchanger, thus improving the reliability and service life of the heat exchanger.

Figure 3:
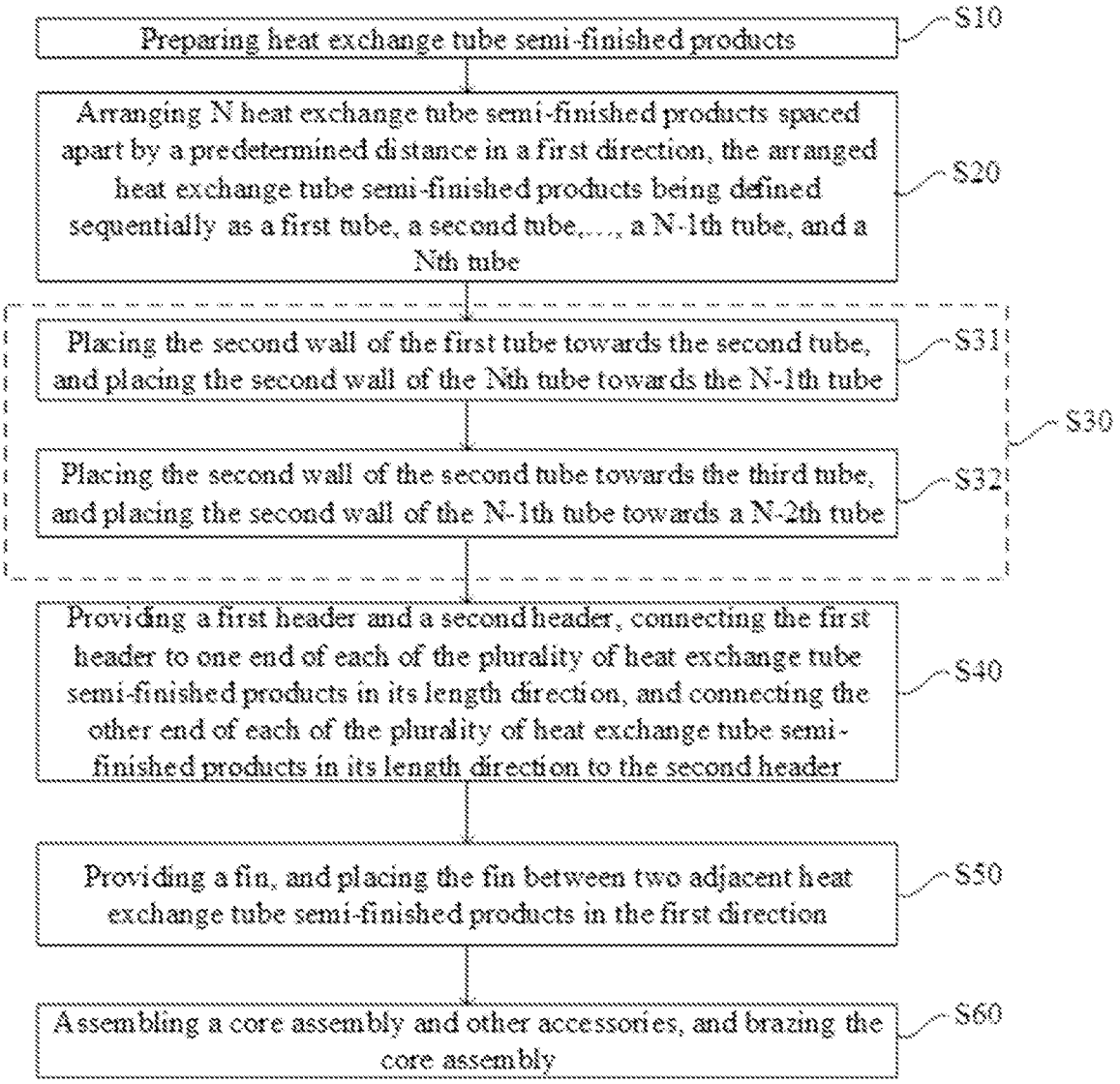
FIG. 3 is a flow chart of another method for processing a heat exchanger provided in an embodiment of the present disclosure.

Further, as shown in FIG. 3, step S30 further includes step S32, that is, step S30 includes step S31 and step S32. Specifically, at step S32, the second wall of the second tube is placed towards a third tube, and the second wall of the second tube is closer to the third tube in the first direction compared to the first wall of the second tube, so that a minimum distance between the second wall of the second tube and the first wall of the third tube is less than a minimum distance between the first wall of the second tube and the first wall of the third tube in the first direction; the second wall of the N−1th tube is placed towards the N−2th tube, and the second wall of the N−1th tube is closer to the N−2th tube in the first direction compared to the first wall of the N−1th tube, so that a minimum distance between the second wall of the N−1th tube and the first wall of the N−2th tube is less than a minimum distance between the first wall of the N−1th tube and the first wall of the N−2th tube in the first direction. That is to say, at the two edges of the heat exchanger, the second walls of two heat exchange tube semi-finished products are oriented towards the inside of the heat exchange tube, respectively. By means of making the first gaps of more heat exchange tube semi-finished products towards the inside of the heat exchanger, the local stress concentration of the heat exchanger is further reduced, thus improving the reliability and service life of the heat exchanger.

Figure 4:
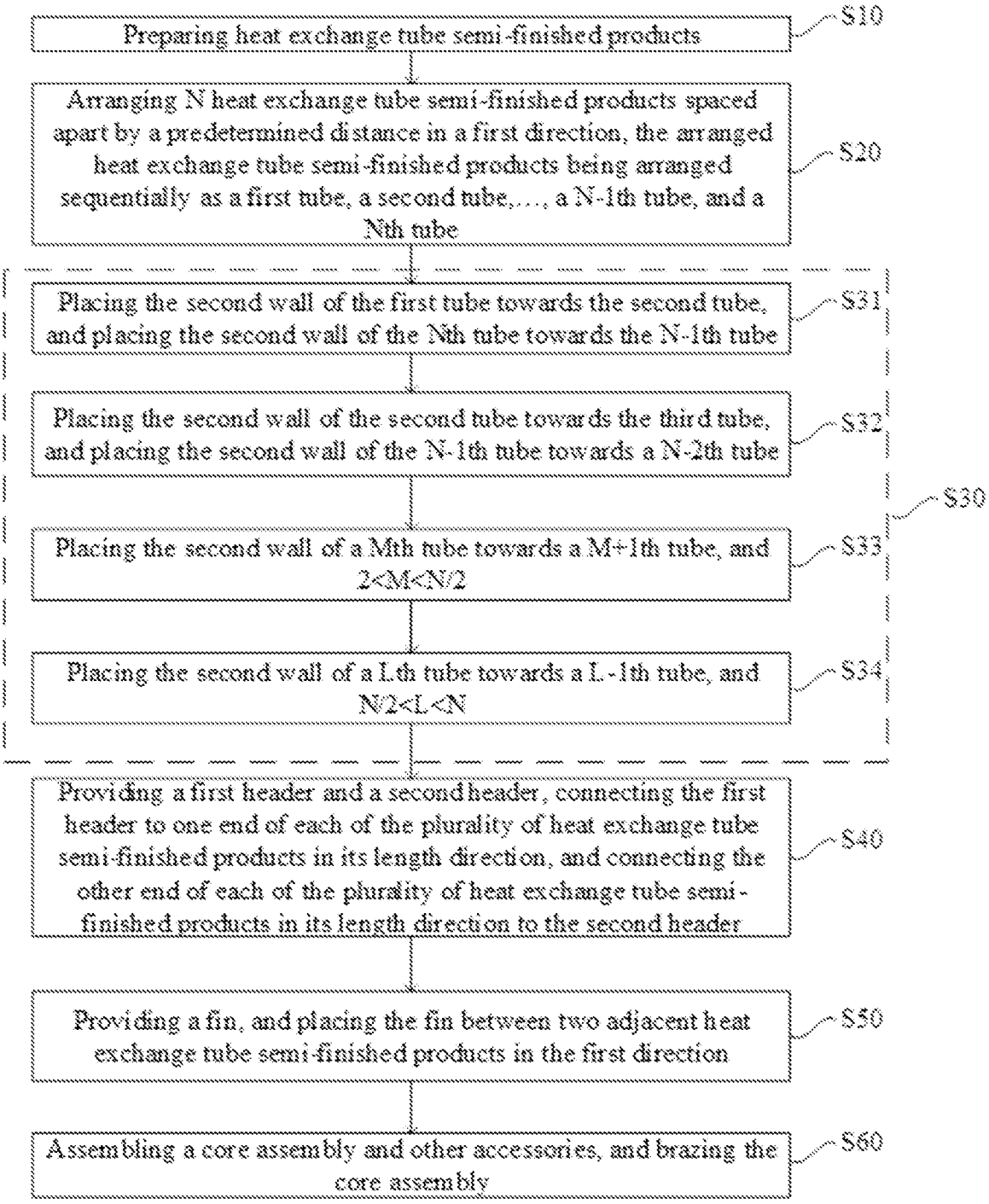
FIG. 4 is a flow chart of another method for processing a heat exchanger provided in an embodiment of the present disclosure.

Further, as shown in FIG. 4, step S30 further includes step S33, that is, step S30 includes step S31, step S32, and step S33. Specifically, at step S32, the second wall of a Mth tube is placed towards a M+1th tube, M is greater than 2 and less than N/2, and the second wall of the Mth tube is closer to the M+1th tube in the first direction compared to the first wall of the Mth tube, so that a minimum distance between the second wall of the Mth tube and the first wall of the M+1th tube is less than a minimum distance between the first wall of the Mth tube and the first wall of the M+1th tube in the first direction.

Further, continuing to refer to FIG. 4, step S30 further includes step S34, that is, step S30 includes step S31, step S32, step S33, and step S34. Specifically, at step S34, the second wall of a Lth tube is placed towards a L−1th tube, L is greater than N/2 and less than N, and the second wall of the Lth tube is closer to the L−1th tube in the first direction compared to the first wall of the Lth tube, so that a minimum distance between the second wall of the Lth tube and the first wall of the L−1th tube is less than a minimum distance between the first wall of the Lth tube and the first wall of the L−1th tube in the first direction.

Figure 5:
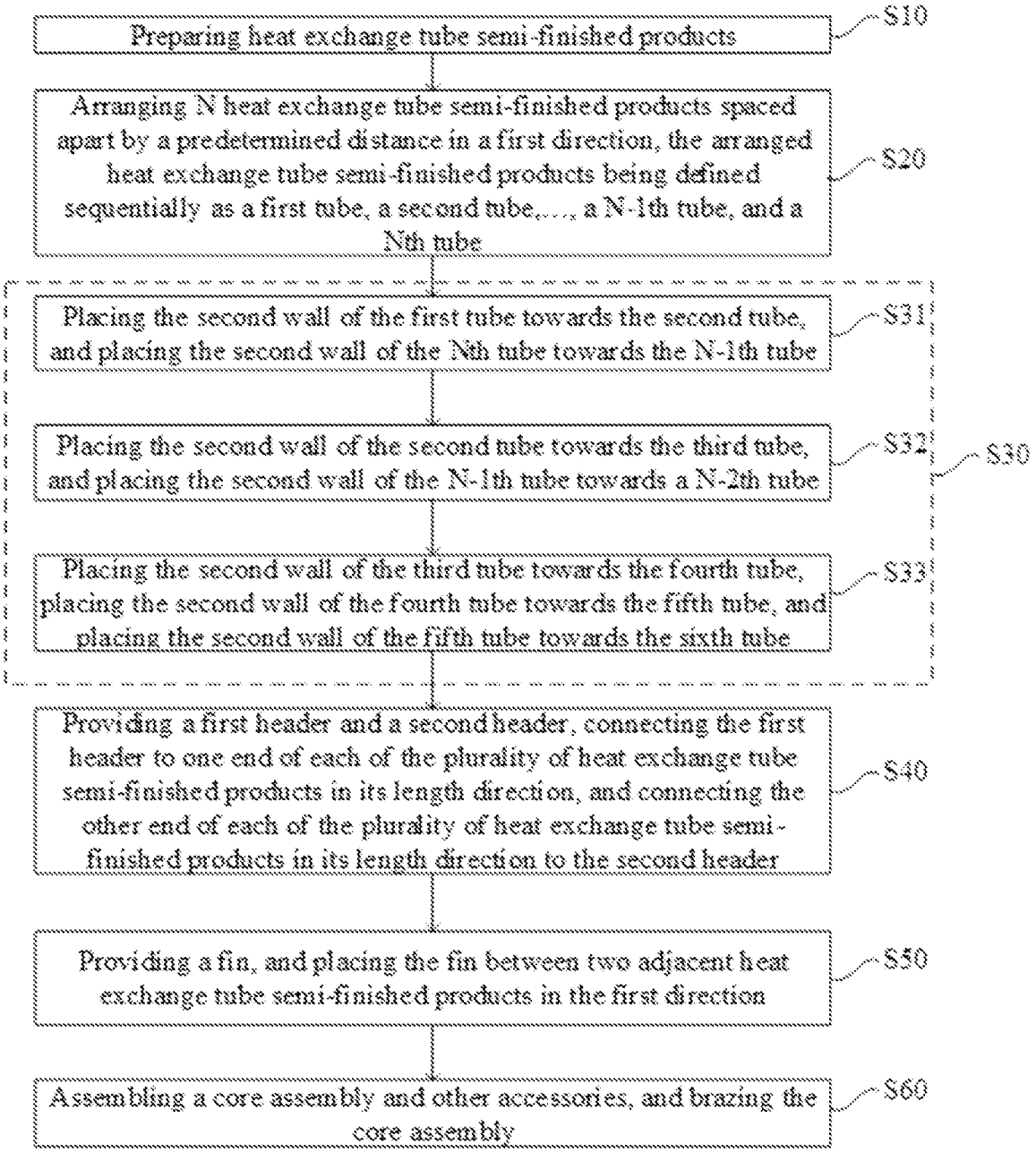
FIG. 5 is a flow chart of another method for processing a heat exchanger provided in an embodiment of the present disclosure.

As shown in FIG. 5, in a specific embodiment, step S33 may specifically include the followings: the second wall of the third tube is placed towards the fourth tube, and the second wall of the third tube is closer to the fourth tube in the first direction compared to the first wall of the third tube, so that a minimum distance between the second wall of the third tube and the first wall of the fourth tube is less than a minimum distance between the first wall of the third tube and the first wall of the fourth tube in the first direction; the second wall of the fourth tube is placed towards a fifth tube, and the second wall of the fourth tube is closer to the fifth tube in the first direction compared to the first wall of the fourth tube, so that a minimum distance between the second wall of the fourth tube and the first wall of the fifth tube is less than a minimum distance between the first wall of the fourth tube and the first wall of the fifth tube in the first direction; and the second wall of the fifth tube is placed towards a sixth tube, and the second wall of the fifth tube is closer to the sixth tube in the first direction compared to the first wall of the fifth tube, so that a minimum distance between the second wall of the fifth tube and the first wall of the sixth tube is less than a minimum distance between the first wall of the fifth tube and the first wall of the sixth tube in the first direction.

Figure 6:
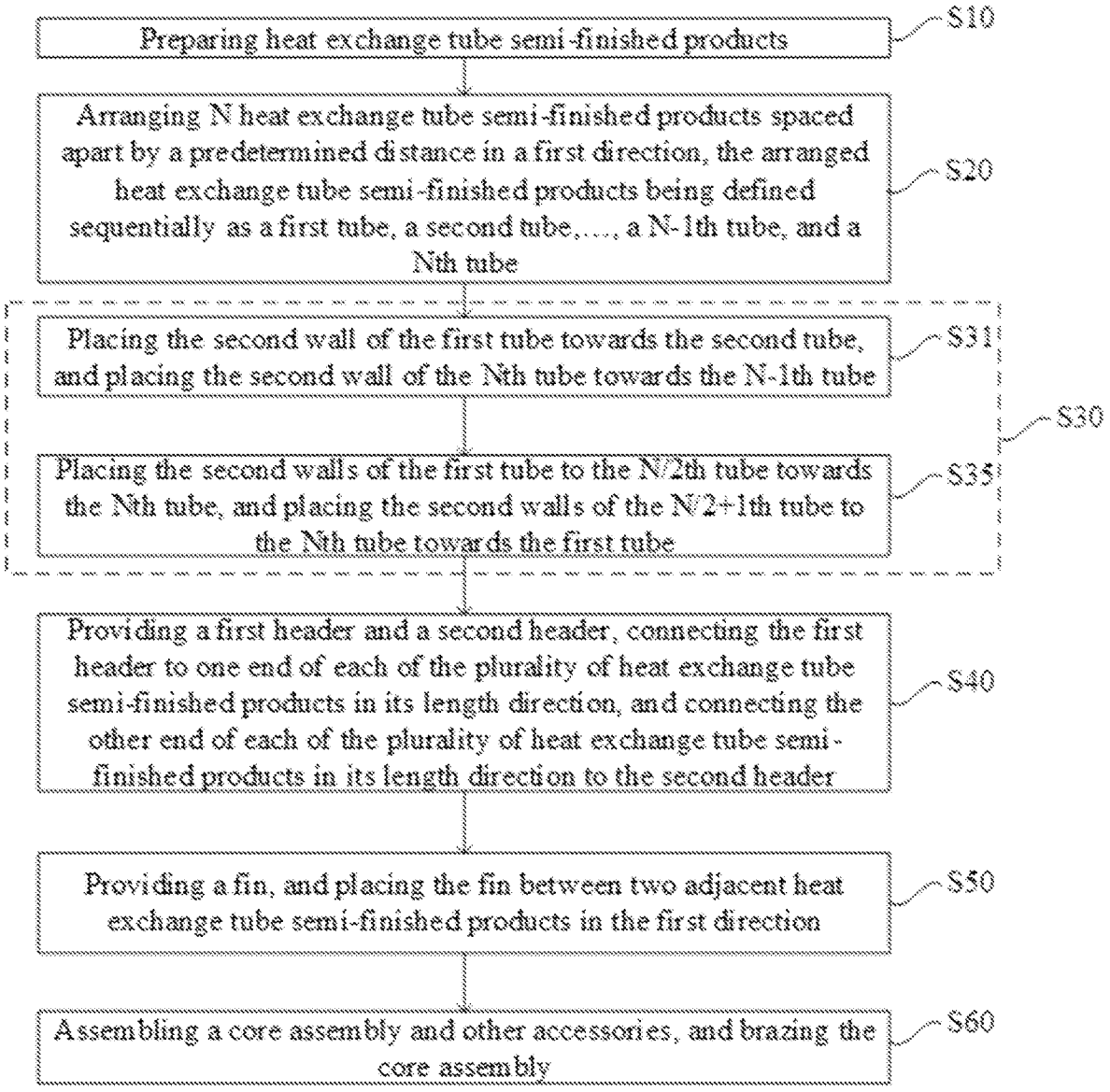
FIG. 6 is a flow chart of another method for processing a heat exchanger provided in an embodiment of the present disclosure.
Figure 7:
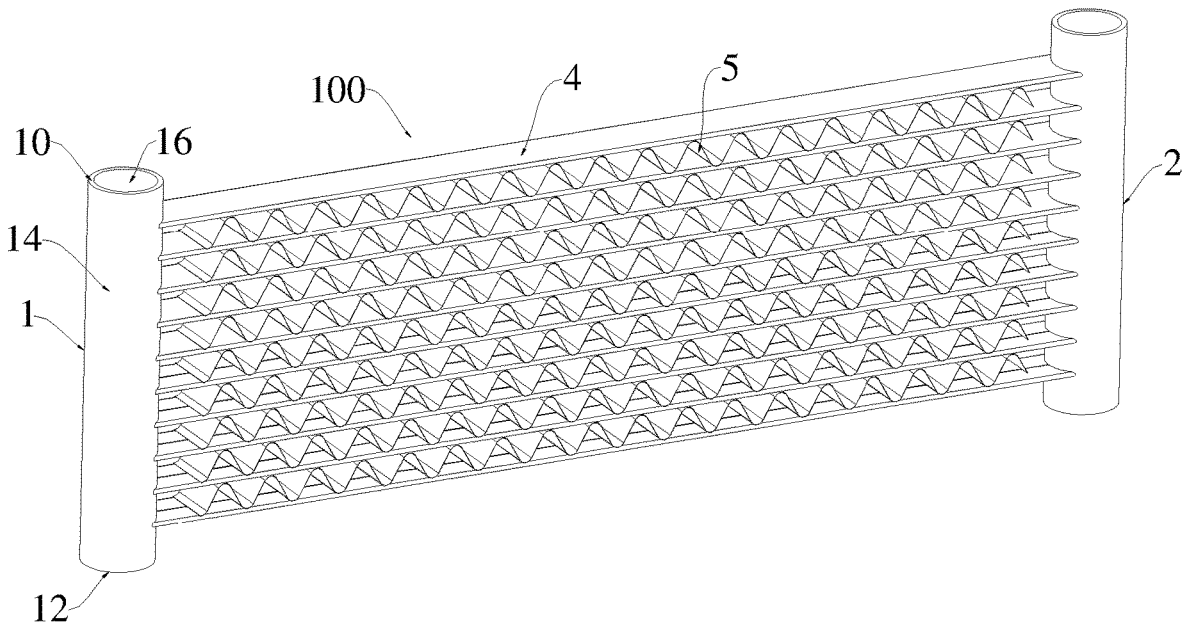
FIG. 7 is a schematic view of a heat exchanger according to an embodiment of the present disclosure.
Figure 8:
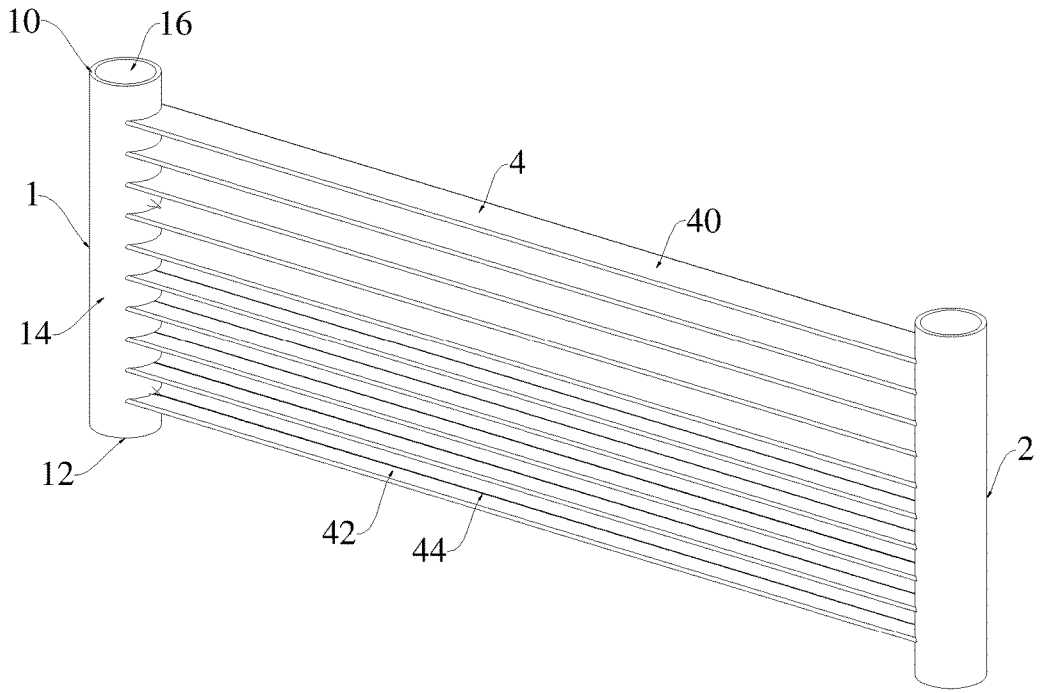
FIG. 8 is a partial schematic view of the heat exchanger shown in FIG. 7.
Figure 9:
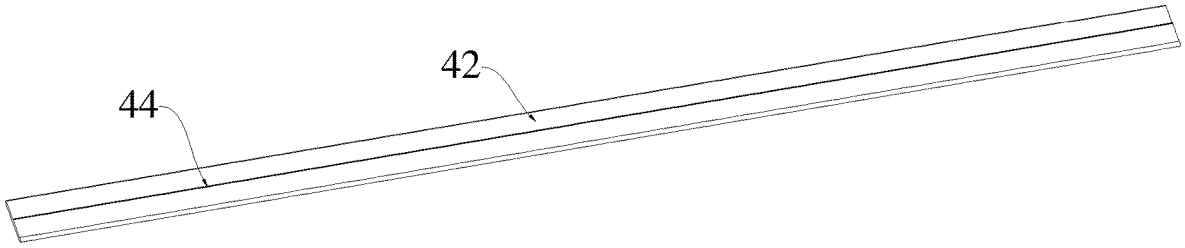
FIG. 9 is a schematic view of a folded tube section according to an embodiment of the present disclosure.
Figure 10:
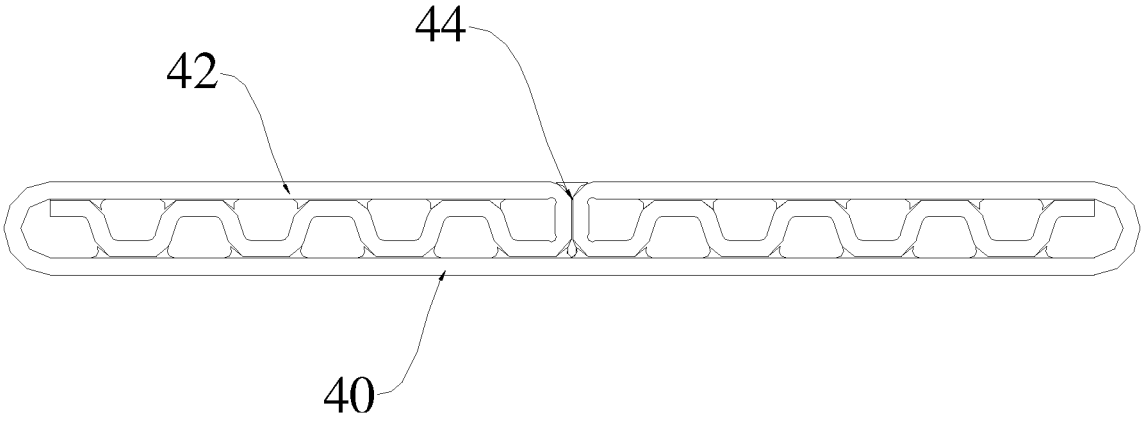
FIG. 10 is a sectional view of the folded tube section shown in FIG. 9.
Figure 11:
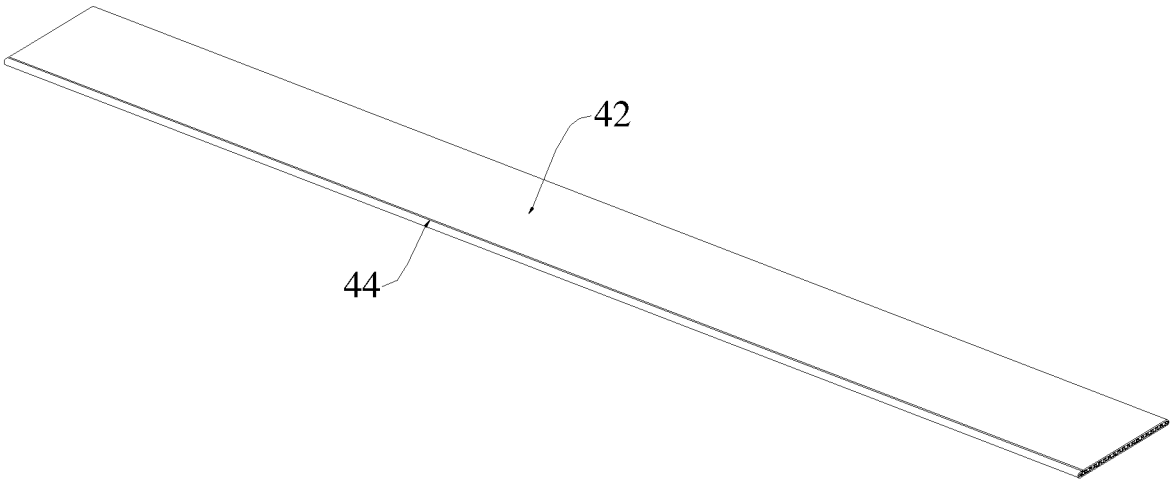
FIG. 11 is a schematic view of a folded tube section according to another embodiment of the present disclosure.
Figure 12:
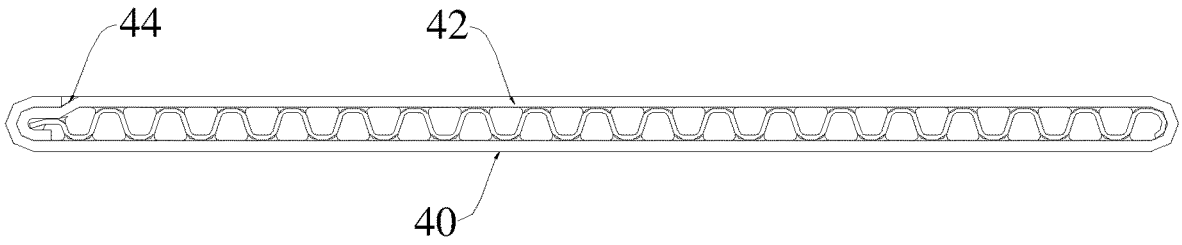
FIG. 12 is a sectional view of the folded tube section shown in FIG. 11.
Figure 13:
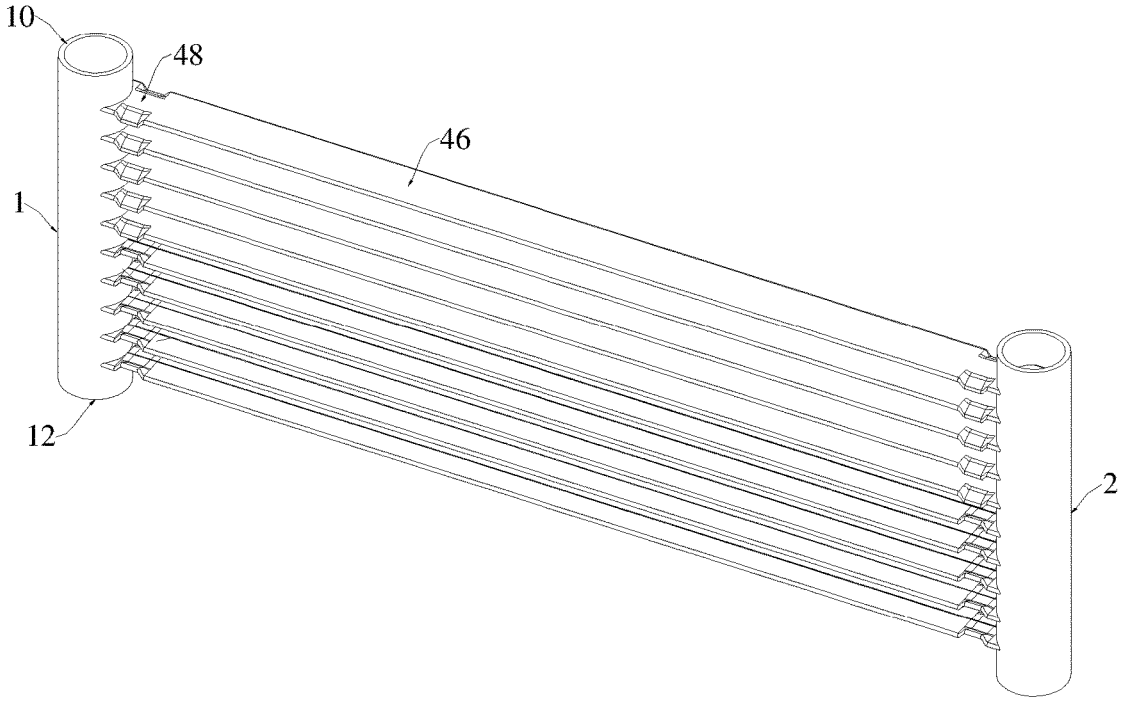
FIG. 13 is a schematic view of a heat exchanger according to another embodiment of the present disclosure, in which a fin is not shown.
Figure 14:
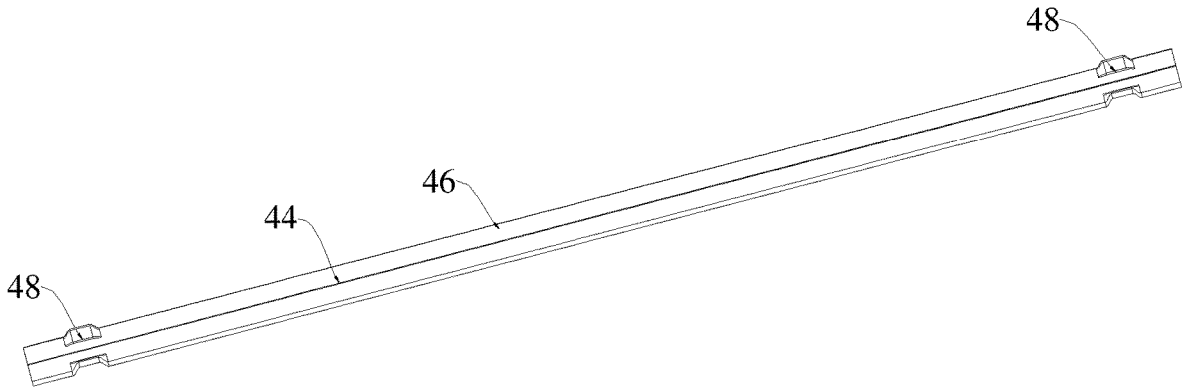
FIG. 14 is a schematic view of a folded tube section in the heat exchanger shown in FIG. 13.
Figure 15:
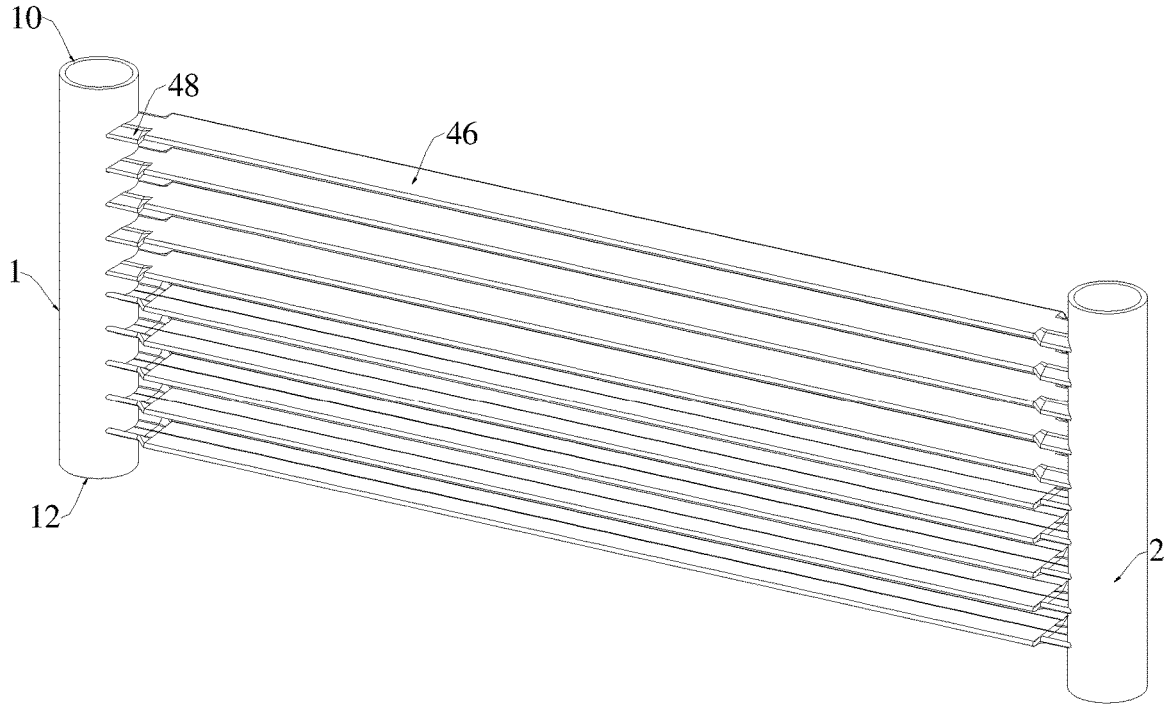
FIG. 15 is a schematic view of a heat exchanger according to another embodiment of the present disclosure, in which a fin is not shown.
Figure 16:
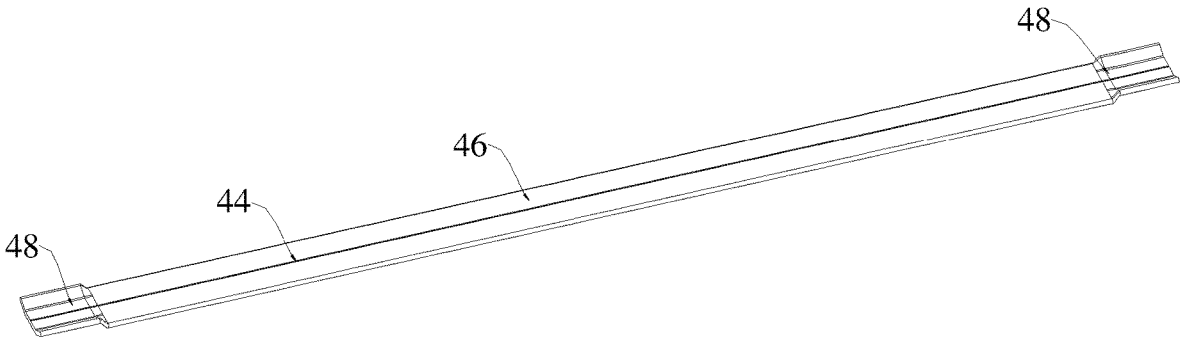
FIG. 16 is a schematic view of a folded tube section in the heat exchanger shown in FIG. 15.

As shown in FIG. 6, step S30 includes step S31 and step S35. Specifically, at step S35, the second walls of the first tube to a N/2th tube are placed towards the Nth tube, and the second walls of the first tube to the N/2th tube are closer to the Nth tube in the first direction compared to the first wall of the N/2th tube, so that a minimum distance between the second walls of the first tube to the N/2th tube and the first wall of the Nth tube is less than a minimum distance between the first walls of the first tube to the N/2th tube and the first wall of the Nth tube in the first direction; and the second walls of a N/2+1th tube to the Nth tube are placed towards the first tube, and the second walls of the N/2+1th tube to the Nth tube are closer to the first tube in the first direction compared to the first wall of the N/2+1th tube, so that a minimum distance between the second walls of the N/2+1th tube to the Nth tube and the first wall of the first tube is less than a minimum distance between the first walls of the N/2+1th tube to the Nth tube and the first wall of the first tube in the first direction. Thus, the first gaps of all the heat exchange tube semi-finished products are oriented towards the inside of the heat exchanger, the local stress concentration of the heat exchanger is reduced as much as possible, and thus the reliability and service life of the heat exchanger are improved. It should be noted that when N is an even number, N/2 may be taken as an integer; when N is an odd number, N/2 is not an integer, and the largest integer less than N/2 may be taken, or the smallest integer greater than N/2 may be taken.

As shown in FIGS. 7 to 16, embodiments of the present disclosure provide a heat exchanger 100, the heat exchanger 100 includes a first header 1, a second header 2 and a heat exchange tube 4, and the heat exchange tube 4 is communicated with the first header 1 and the second header 2.

The heat exchange tube 4 only includes a folded tube section formed by welding an alloy plate after being folded, and the folded tube section includes one or more channels extending along its length direction. There are a plurality of folded tube sections arranged at intervals along a length direction of the first header 1. The folded tube section includes a tube wall including a first seam 44, and the first seam 44 extends along a length direction of the folded tube section. The tube wall includes a first wall 40 and a second wall 42 arranged along a thickness direction of the folded tube section, and the second wall 42 includes the first seam 44. One end of the first header 1 in its length direction includes a first end face 10, and the other end of the first header 1 in its length direction includes a second end face 12. The first walls 40 of X folded tube sections are closer to the first end face 10 compared to the second walls 42 of the folded tube sections, the X folded tube sections are closer to the first end face 10 compared to the second end face 12, and X≥1. That is to say, in the folded tube sections close to the first end face 10, the second wall 42 of at least one of the folded tube sections faces away from the first end face 10. The first walls 40 of Y folded tube sections are closer to the second end face 12 compared to the second walls 42 of the folded tube sections, the Y folded tube sections are closer to the second end face 12 compared to the first end face 10, and Y≥1. That is to say, in the folded tube sections close to the second end face 12, the second wall 42 of at least one of the folded tube sections faces away from the second end face 12. This structure allows the first seams 44 of all the folded tube sections included in the heat exchanger 100 to have two different orientations. Due to the first seam on the second wall of the heat exchange tube, and a significant temperature difference between the inside and the outside of the heat exchanger 100 during working, the second wall 42 of the folded tube section is more prone to the local stress concentration than the first wall 40. By means of changing the orientation of the first seam 44, it facilitates the reduction of local stress concentration of the heat exchanger 100, thereby improving the reliability and corrosion resistance of the heat exchanger 100.

Specifically, when the heat exchanger 100 is working, there is a temperature difference between the working temperature of the heat exchanger 100 and the ambient temperature, and the heat exchanger 100 is subjected to the local thermal stress concentration, so that the heat exchange tube deforms, thus resulting in damage and leakage of the heat exchanger 100 and affecting the reliability, corrosion resistance and service life of the heat exchanger 100. Especially for the joint welding seam on a surface of the folded tube section, the second wall 42 with the welding seam is more prone to the local stress concentration compared to the first wall 40 without the welding seam. The first seams 44 of the folded tube sections at two outside ends of the heat exchanger 100 provided in the embodiments of the present disclosure have two different orientations. Due to the first seam 44 on the second wall 42 of the heat exchange tube, and the temperature difference between the inside and the outside of the heat exchanger 100 during working, the second wall 42 of the folded tube section is more prone to the stress concentration compared to the first wall 40. By means of changing the orientation of the first seam 44, it facilitates the reduction of local stress concentration of the heat exchanger, thus improving the reliability and service life of the heat exchanger 100.

Further, the first walls 40 of X folded tube sections are closer to the first end face 10 than the second walls 42 of the folded tube sections, and in all the folded tube sections, the X folded tube sections are arranged sequentially from a position closest to the first end face 10 to a position close to the second end face 12. The first walls 40 of Y folded tube sections are closer to the second end face 12 than the second walls 42 of the folded tube sections, and in all the folded tube sections, the Y folded tube sections are arranged sequentially from a position closest to the second end face 12 to a position close to the first end face 10.

The first seam 44 may be located in a center of the second wall 42. As shown in FIG. 5 and FIG. 6, the first seam 44 may be located at an edge of the second wall 42.

In some embodiments, the first seam 44 is filled with the solder, and when the heat exchanger 100 is in the welding process, after the solder on the surface of the folded tube section is heated and melted, part of the solder is accumulated in the first seam 44, which facilitates improving the reliability of the folded tube section.

Further, the heat exchanger 100 further includes a fin 5, the fin 5 may provide the corrosion resistance and reliability of the heat exchanger, and also affects the distribution of the thermal stress on the heat exchanger. The fin 5 may be a corrugated fin, the fin 5 is located between adjacent folded tube sections in the length direction of the first header, one or more corrugated fins may be arranged between adjacent heat exchange tubes, and when there is only one corrugated fin between the adjacent heat exchange tubes, a height of the fin 5 is H1 which refers to a maximum height size of the fin. The fin 5 may also be a transverse insertion fin, the transverse insertion fins are arranged at intervals along the length direction of the folded tube section, and part of the transverse insertion fin is located between two adjacent folded tube sections in the length direction of the first header 1. When the fin 5 is the transverse insertion fin, the height H1 of the fin 5 refers to a maximum height size of the part of the fin located between the adjacent heat exchange tubes in the length direction of the first header.

Further, the heat exchange tube 4 is a flat tube, the first header 1 includes a third wall 14 and a first channel 16, and a wall enclosing the first channel 16 includes the third wall 14. The heat exchanger 100 satisfies following relationships:

$$X \geqslant \left|\frac{H}{8} \cdot \frac{(D+8d)}{100h}\right|, \text{ and/or } Y \geqslant \left|\frac{H}{8} \cdot \frac{(D+8d)}{100h}\right|.$$

When the number of X or Y satisfies this relationship, it facilitates the reduction of the local stress concentration of the heat exchanger, thus improving the reliability and service life of the heat exchanger 100.

D is a hydraulic diameter of the first header 1, d is a thickness of the third wall 14, H is a distance between the two adjacent heat exchanger tubes 4 in the length direction of the first header 1, h is a thickness of the alloy plate, and || indicates rounding.

Further, the folded tube sections are processed in different welding terminals, and the time of welding processing is different, which also has a certain correlation relationship with the arrangement of the first seam on the folded tube section. There is an optimal interval range in the welding process of the heat exchanger 100, which facilitates the reduction of local stress concentration of the heat exchanger 100, thereby improving the reliability of the heat exchanger 100. There is also a certain relationship between the X folded tube sections, the Y folded tube sections, a welding temperature difference TW and a welding duration t as follows:

$$\left|\frac{H}{8} \cdot \frac{(D+8d)}{100h}\right| \cdot \left|\frac{T_W}{10} \cdot \frac{t}{200}\right|.$$

Tw is in degrees Celsius, t is in seconds, the result is dimensionless, its integer value is taken, and X and Y should be greater than the integer value. The welding temperature difference refers to a difference between a maximum welding temperature and a temperature at which a composite layer begins to melt, and t is the time when the welding temperature is higher than the temperature at which the composite layer melts in the welding process. Tw and T are related to the material of the heat exchange tube 4, the structure of the heat exchange tube 4, and other parameters in the welding process. For the processing manner of an integral furnace welding of an aluminum alloy heat exchanger 100, $$\left|\frac{T_W}{10} \cdot \frac{t}{200}\right|$$

is generally greater than or equal to 2.

It may be seen that the first header 1 includes the third wall 14 and the first channel 16, and the wall enclosing the first channel 16 includes the third wall 14. The heat exchanger 100 satisfies following relationships:

$$X \geqslant 2\left|\frac{H}{8} \cdot \frac{(D+8d)}{100h}\right|, \text{ and/or } Y \geqslant 2\left|\frac{H}{8} \cdot \frac{(D+8d)}{100h}\right|.$$

D is the hydraulic diameter of the first header 1, d is the thickness of the third wall 14, H is the distance between the two adjacent heat exchanger tubes 4 in the length direction of the first header 1, h is the thickness of the alloy plate, and || indicates rounding.

Figure 19:
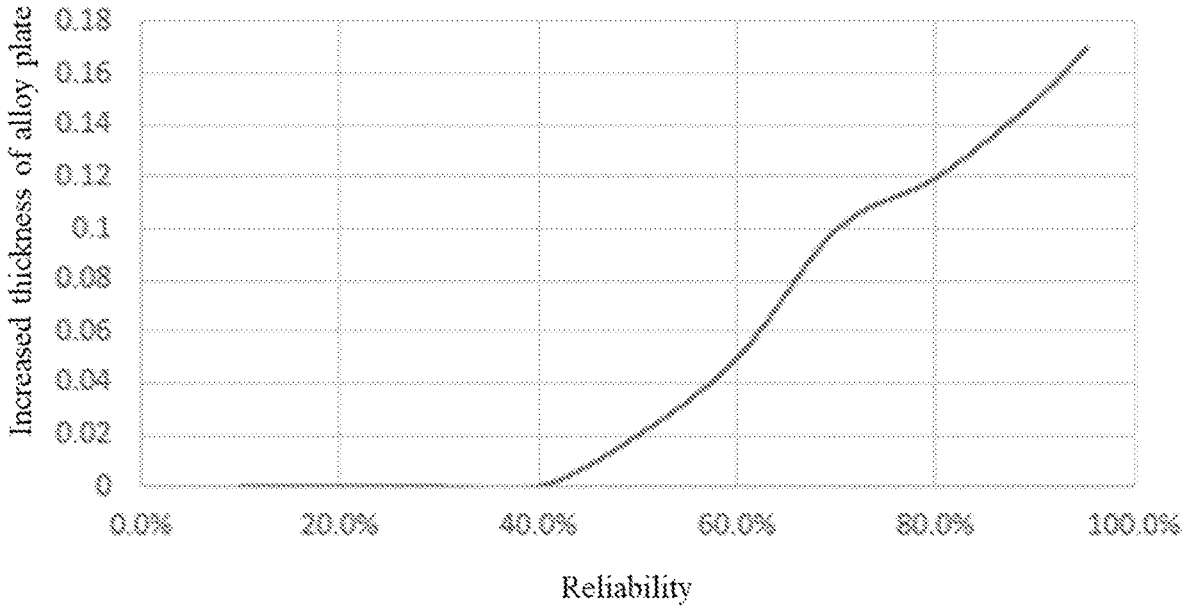
FIG. 19 shows a relationship between a thickness and reliability of an alloy plate of a heat exchanger according to an embodiment of the present disclosure.

Further, with reference to FIG. 19, a thickness of the tube wall is less than or equal to 0.5 mm, the thickness of the tube wall is less than or equal to the thickness of the alloy plate, the first header 1 includes the third wall 14 and the first channel 16, the wall enclosing the first channel 16 includes the third wall 14, and the heat exchanger 100 satisfies following relationships:

$$X \geqslant \left|\frac{3H}{8} \cdot \frac{(D+8d)}{100h}\right|, \text{ and/or } Y \geqslant \left|\frac{3H}{8} \cdot \frac{(D+8d)}{100h}\right|.$$

D is the hydraulic diameter of the first header 1, d is the thickness of the tube wall of the first header 1, H is the distance between the two adjacent heat exchanger tubes 4 in the length direction of the first header 1, h is the thickness of the alloy plate, and || indicates rounding.

Figure 20:
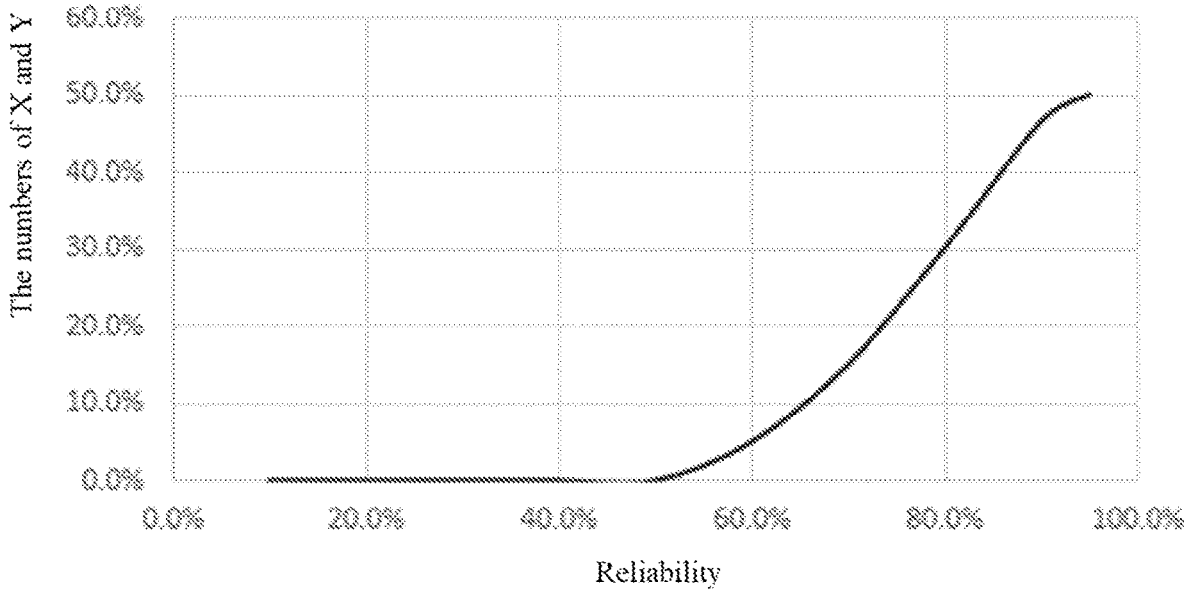
FIG. 20 shows a relationship between X, Y and reliability of a heat exchanger according to an embodiment of the present disclosure.

Further, with reference to FIG. 20, the strength and reliability of the heat exchange tube 4 are related to the number of channels in the heat exchange tube 4, the more the number of channels, the better the strength and reliability of the heat exchanger tube 4. On the other hand, the number of channels affects the width of the heat exchange tube and the welding quality of the first seam 44, the more the number of channels, the more solder joints of the heat exchange tube, which is not conducive to the welding of the joint seam, and affects the welding quality. Therefore, as the number of channels increases, it is necessary to change the structure of the heat exchanger 100 to improve the reliability of the heat exchanger 100.

Specifically, the heat exchange tube 4 includes the plurality of channels arranged at intervals along its width direction, the number of channels included in the heat exchange tube 4 is greater than 8, the first header 1 includes the third wall 14 and the first channel 16, and the wall enclosing the first channel 16 includes the third wall 14, and the heat exchanger 100 satisfies following relationships:

$$X \geqslant \left|\frac{H}{2} \cdot \frac{(D+8d)}{100h}\right|, \text{ and/or } Y \geqslant \left|\frac{H}{2} \cdot \frac{(D+8d)}{100h}\right|.$$

D is the hydraulic diameter of the first header 1, d is the thickness of the third wall 14, H is the distance between the two adjacent heat exchanger tubes 4 in the length direction of the first header 1, h is the thickness of the alloy plate, and || indicates rounding.

In an embodiment, $3 \leq X \leq 5$, and/or $3 \leq Y \leq 5$, for example, X is 3, 4, or 5, and Y is 3, 4, or 5. Considering the different inside-outside temperature differences in the working process of the heat exchanger and the size difference of the heat exchanger, the number of the heat exchange tubes with the welding seems facing inwards is 3 to 5, which are distributed on an outermost one of one side or both sides of a heat exchange tube group of the heat exchanger, this is better for the improvement of the thermal stress distribution of the heat exchanger, and facilitates improving the corrosion resistance.

In another embodiment, the number of the heat exchanger tubes 4 arranged in the length direction of the first header 1 is N, and the heat exchanger 100 satisfies a following relationship: X=Y=N/2. That is to say, for all the heat exchange tubes 4 close to the first end face 10, the first walls 40 are closer to the first end face 10 than the second walls 42 of these heat exchanger tubes 4; and for all the heat exchange tubes 4 close to the second end face 12, the first walls 40 are closer to the second end face 12 than the second walls 42 of these heat exchange tubes 4.

Further, the heat exchange tube 4 includes a main body portion 46 and a bent portion 48, and a length direction of at least part of the bent portion 48 is not parallel to a length direction of the main body portion 46. The arrangement of the bent portion 48 facilitates further reducing the stress generated by the heat exchange tube 4 in the welding process, and the reliability of the heat exchanger 100 is improved. In addition, by means of arranging the bent portion 48, it may also play the role of distinguishing the direction, and prevent the first wall 40 and the second wall 42 from being reversed when installing the heat exchange tube 4.

Further, in the length direction of the main body portion 46, the first header 1, the bent portion 48, and the main body portion 46 are sequentially arranged. The first wall 40 of at least part of the bent portion 48 is closer to the first end face 10 compared to the first wall 40 of the main body portion 46, and the second wall 42 of the part of the bent portion 48 is further away from the second end face 12 compared to the second wall 42 of the main body portion 46. That is to say, the bent portion 48 is arranged at either end of the folded tube section, so that the bent portion 48 may be adjacent to the first header 1. In the overall welding process of the heat exchanger, the bent portion 48 plays the role of blocking flow, preventing the molten solder on the tube wall of the first header 1 or on the surface of the heat exchange tube 4 from flowing into the first seam 44 in the processing of the heat exchanger 100. As more and more solders accumulate in the first seam, it may affect the reliability or heat exchange performance of the heat exchange tube. By means of arranging the bent portion 48 at an end portion of the folded tube section, the accumulation of solders in the first seam 44 may be reduced, this facilitates improving the reliability of the heat exchange tube, and the heat exchange performance is improved.

Figure 17:
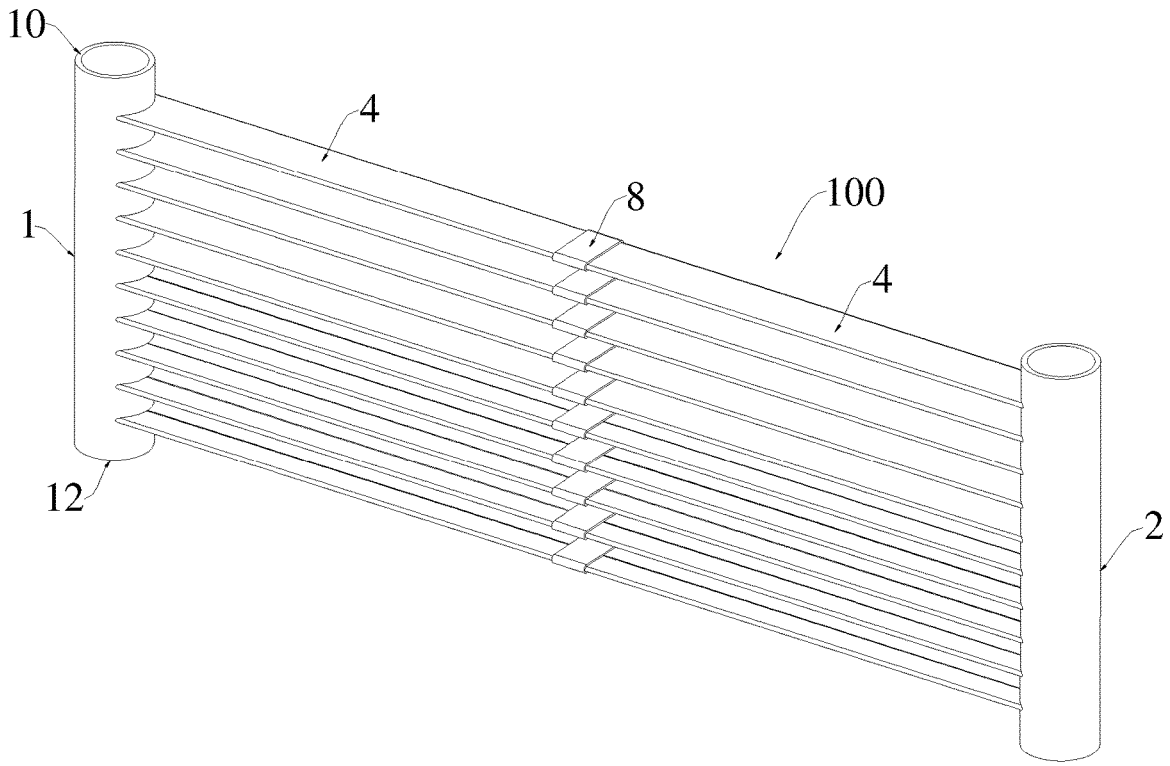
FIG. 17 is a schematic view of a heat exchanger according to another embodiment of the present disclosure.

As shown in FIG. 17, embodiments of the present disclosure provide another heat exchanger 100, the heat exchanger 100 includes a first header 1, a second header 2 and a heat exchange tube 4, and the heat exchange tube 4 is communicated with the first header 1 and the second header 2. The heat exchanger 100 differs from the above embodiment in that the heat exchange tube 4 includes a casing tube 8 and at least two heat exchange tube sections, the heat exchange tube section is formed by welding the heat exchange tube semi-finished product, the at least two heat exchange tube sections are arranged sequentially along the length direction of the heat exchange tube 3, and two adjacent heat exchange tube sections included in the same heat exchange tube 3 are connected through the casing tube 8. That is to say, one end of the heat exchange tube section along its length direction is directly connected with the first header 1 or the second header 2, and the other end of the heat exchanger tube section along its length direction is indirectly connected with the second header 2 or the first header 1.

Figure 18:
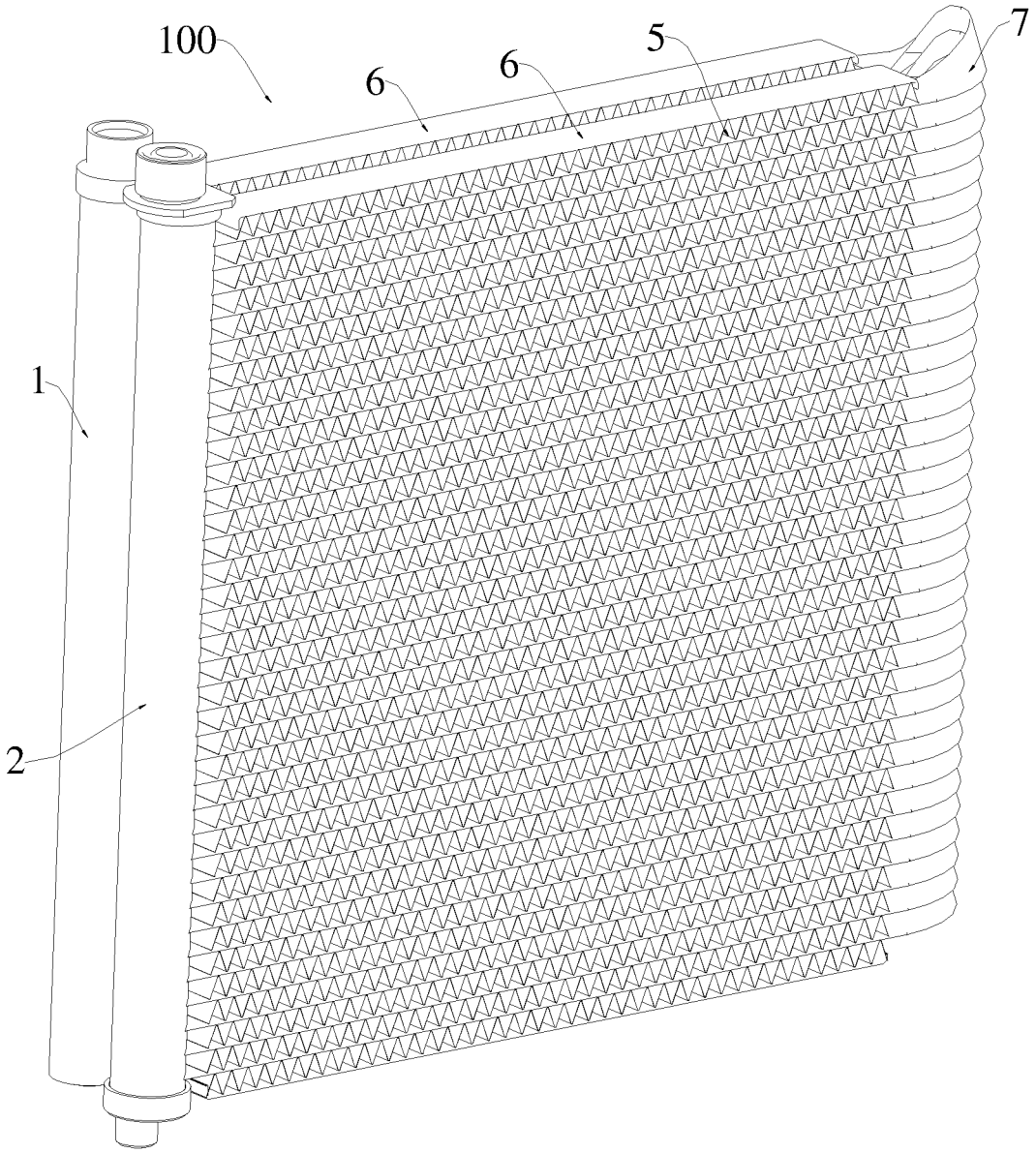
FIG. 18 is a schematic view of a heat exchanger according to another embodiment of the present disclosure.

As shown in FIG. 18, embodiments of the present disclosure provide another heat exchanger 100, the heat exchanger 100 includes a first header 1, a second header 2 and a heat exchange tube 4, and the heat exchange tube 4 is communicated with the first header 1 and the second header 2. The heat exchanger 100 differs from the above embodiment in that the heat exchange tube 4 includes a plurality of straight portions 6 and a curved portion 7. The straight portion 6 includes a heat exchange tube section, the heat exchange tube section is formed by welding a heat exchange tube semi-finished product, one end of the curved portion 7 is communicated with a first straight portion 6, the other end of the curved portion 7 is communicated with a second straight portion 6, a length direction of the first straight portion 6 is parallel or angled to a length direction of the second straight portion 6, and one or more curved portions 7 are provided. That is to say, one end of the heat exchange tube section along its length direction is directly connected with the first header 1 or the second header 2, and the other end of the heat exchange tube section along its length direction is indirectly connected with the second header 2 or the first header 1.

The above is only a preferred embodiment of the present disclosure, which is not intended to limit the present disclosure, and the present disclosure may have various alternations and variations for those skilled in the art. Any modifications, equivalent alternatives, improvements, etc., made within the spirit and principles of the present disclosure shall fall within the protection scope of the present disclosure.

In the description of the present disclosure, it should be understood that the orientation or position relationship indicated by the terms "center", "longitudinal", "transverse", "length", "width", "thickness", "up", "down", "front", "rear", "left", "right", "vertical", "horizontal", "top", "bottom", "inner", "outer", "clockwise", "counterclockwise", "axial", "radial" and "circumferential" and the like, is based on the orientation or position relationship shown in the accompanying drawings, which is only for the convenience of describing the present disclosure and simplifying the description, and does not indicate or imply that the referred device or element must have a specific orientation, and be constructed and operated in a specific orientation, so it cannot be understood as a limitation of the present disclosure.

In addition, the terms "first" and "second" are only used for purpose of description, and cannot be understood as indicating or implying relative importance or implicitly indicating the number of indicated technical features. Therefore, the feature defined as "first" or "second" may explicitly or implicitly include at least one such feature. In the description of the present disclosure, "a plurality of" means at least two, such as two, three, etc., unless otherwise specifically defined.

In the present disclosure, unless otherwise expressly defined, terms such as "install/mount", "interconnect", "connect", "fix" shall be understood broadly, and may be, for example, fixed connections, detachable connections, or integral connections; may also be mechanical or electrical connections or intercommunication; may also be direct connections or indirect connections via intervening media; may also be inner communications or interactions of two elements, unless otherwise specifically defined. For those skilled in the art, the specific meaning of the above terms in the present disclosure can be understood according to the specific situations.

In the present disclosure, unless otherwise expressly defined, the first feature "below", "under", "on bottom of", "above", "on", or "on top of" a second feature may include an embodiment in which the first feature is in direct contact with the second feature, or the first feature is in indirect contact with the second feature through an intermediate media. And, the first feature "above", "on", or "on top of" a second feature may include an embodiment in which the first feature is right or obliquely "above", "on", or "on top of" the second feature, or just means that the first feature is at a height higher than that of the second feature. A first feature "below", "under", or "on bottom of" a second feature may include an embodiment in which the first feature is right or obliquely "below", "under", or "on bottom of" the second feature, or just means that the first feature is at a height lower than that of the second feature.

In the description of the present specification, the description referring to terms such as "an embodiment", "some embodiments", "an example", "a specific example" or "some examples" means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present invention. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although the embodiments of the present disclosure have been shown and described above, it can be understood that the above embodiments are illustrative and shall not be understood as limitation to the present disclosure, and changes, modifications, alternatives and variations can be made in the above embodiments within the scope of the present disclosure by those skilled in the art.

The invention claimed is:

1. A method for processing a heat exchanger, comprising:

preparing a plurality of heat exchange tube semi-finished products, each of the plurality of heat exchange tube semi-finished products comprising a first wall and a second wall arranged in a thickness direction of the each of the plurality of heat exchange tube semi-finished products, the each of the plurality of heat exchange tube semi-finished products having a first gap, wherein the first gap is configured to be filled with a solder to form a first seam, and the first gap is arranged on a surface of the second wall outside of the each of the plurality of heat exchange tube semi-finished products and penetrates into the second wall along in the thickness direction;

arranging N heat exchange tube semi-finished products spaced apart in a first direction, wherein the N>4, the thickness direction of the plurality of heat exchange tube semi-finished products is parallel or angled to the first direction, and in the first direction, the plurality of heat exchange tube semi-finished products are sequentially defined as a first tube, a second tube, . . . , a N−1th tube, and a Nth tube;

placing the second wall of the first tube towards the second tube, and the second wall of the first tube being closer to the second tube in the first direction compared to the first wall of the first tube, so that, in the first direction, a distance between the second wall of the first tube and the first wall of the second tube is less than a distance between the first wall of the first tube and the first wall of the second tube; and placing the second wall of the Nth tube towards the N−1th tube, and the second wall of the Nth tube being closer to the N−1th tube in the first direction compared to the first wall of the Nth tube, so that, in the first direction, a distance between the second wall of the Nth tube and the first wall of the N−1th tube is less than a distance between the first wall of the Nth tube and the first wall of the N−1th tube.

2. The method for processing the heat exchanger according to claim 1, further comprising:

placing the second wall of the second tube towards a third tube, and the second wall of the second tube being closer to the third tube in the first direction compared to the first wall of the second tube, so that a distance between the second wall of the second tube and the first wall of the third tube is less than a distance between the first wall of the second tube and the first wall of the third tube in the first direction; and placing the second wall of the N−1th tube towards a N−2th tube, and the second wall of the N−1th tube being closer to the N−2th tube in the first direction compared to the first wall of the N−1th tube, so that a distance between the second wall of the N−1th tube and the first wall of the N−2th tube is less than a distance between the first wall of the N−1th tube and the first wall of the N−2th tube in the first direction.

3. The method for processing the heat exchanger according to claim 1, further comprising:

placing the second wall of a Mth tube towards a M+1th tube, 2<M<N/2, and the second wall of the Mth tube being closer to the M+1th tube in the first direction compared to the first wall of the Mth tube, so that a distance between the second wall of the Mth tube and the first wall of the M+1th tube is less than a distance between the first wall of the Mth tube and the first wall of the M+1th tube in the first direction.

4. The method for processing the heat exchanger according to claim 3, further comprising:

placing the second wall of a Lth tube towards a L−1th tube, N/2<L<N, and the second wall of the Lth tube being closer to the L−1th tube in the first direction compared to the first wall of the Lth tube, so that a minimum distance between the second wall of the Lth tube and the first wall of the L−1th tube is less than a minimum distance between the first wall of the Lth tube and the first wall of the L−1th tube in the first direction.

5. The method for processing the heat exchanger according to claim 1, further comprising:

placing the second wall of a third tube towards a fourth tube, and the second wall of the third tube being closer to the fourth tube in the first direction compared to the first wall of the third tube, so that a distance between the second wall of the third tube and the first wall of the fourth tube is less than a distance between the first wall of the third tube and the first wall of the fourth tube in the first direction;

placing the second wall of the fourth tube towards a fifth tube, and the second wall of the fourth tube being closer to the fifth tube in the first direction compared to the first wall of the fourth tube, so that a distance between the second wall of the fourth tube and the first wall of the fifth tube is less than a distance between the first wall of the fourth tube and the first wall of the fifth tube in the first direction; and placing the second wall of the fifth tube towards a sixth tube, and the second wall of the fifth tube being closer to the sixth tube in the first direction compared to the first wall of the fifth tube, so that a distance between the second wall of the fifth tube and the first wall of the sixth tube is less than a distance between the first wall of the fifth tube and the first wall of the sixth tube in the first direction.

6. The method for processing the heat exchanger according to claim 1, further comprising:

placing the second walls of the first tube towards a N/2th tube towards the Nth tube, and the second walls of the first tube to the N/2th tube being closer to the Nth tube in the first direction compared to the first wall of the N/2th tube, so that a distance between the second walls of the first tube to the N/2th tube and the first wall of the Nth tube is less than a distance between the first walls of the first tube to the N/2th tube and the first wall of the Nth tube in the first direction; and placing the second walls of a N/2+1th tube to the Nth tube towards the first tube, and the second walls of the N/2+1th tube to the Nth tube being closer to the first tube in the first direction compared to the first wall of the N/2+1th tube, so that a distance between the second walls of the N/2+1th tube to the Nth tube and the first wall of the first tube is less than a distance between the first walls of the N/2+1th tube to the Nth tube and the first wall of the first tube in the first direction.

7. The method for processing the heat exchanger according to claim 1, further comprising:

providing a first header and a second header, connecting one end of the each of the plurality of heat exchange tube semi-finished products in its length direction with the first header directly or indirectly, and connecting another end of the each of the plurality of heat exchange tube semi-finished products in its length direction with the second header directly or indirectly.

8. The method for processing the heat exchanger according to claim 7, further comprising at least one of:

providing a fin, and placing the fin between two adjacent heat exchange tube semi-finished products in the first direction; or providing a fin, and placing a part of the fin between two adjacent heat exchange tube semi-finished products in the first direction.

* * * * *